US005622263A

United States Patent [19]

Greenland

[11] Patent Number: 5,622,263

[45] Date of Patent: Apr. 22, 1997

[54] SAMPLER PACKAGE AND METHOD OF MAKING THE SAME

[75] Inventor: Steven J. Greenland, Stratham, N.H.

[73] Assignee: Webcraft Technologies, Inc., Horsham, Pa.

[21] Appl. No.: 431,781

[22] Filed: May 1, 1995

[51] Int. Cl.[6] ..... B65B 31/00

[52] U.S. Cl. ..... 206/581; 206/484; 206/823

[58] Field of Search ..... 206/581, 775, 206/776, 484, 484.2, 460, 461, 813, 823

[56] References Cited

U.S. PATENT DOCUMENTS

| | | |
|---|---|---|
| Re. 32,929 | 5/1989 | Ewing . |
| 2,750,075 | 6/1956 | Land et al. . |
| 2,903,393 | 9/1959 | Allen et al. . |
| 3,145,514 | 8/1964 | Steffey . |
| 3,217,871 | 11/1965 | Lee . |
| 3,256,981 | 6/1966 | Kurtz . |
| 3,269,278 | 8/1966 | Olstad . |
| 3,462,329 | 8/1969 | Beyer . |
| 3,685,734 | 8/1972 | Paciorek et al. . |
| 3,879,492 | 4/1975 | Bontinick . |
| 3,937,798 | 2/1976 | Kitajima et al. . |
| 4,145,001 | 3/1979 | Weyenberg et al. . |
| 4,184,099 | 1/1980 | Lindauer et al. . |
| 4,242,167 | 12/1980 | Hoffmann . |
| 4,277,024 | 7/1981 | Spector . |
| 4,279,344 | 7/1981 | Holloway, Jr. . |
| 4,283,011 | 8/1981 | Spector . |
| 4,294,637 | 10/1981 | Rump . |
| 4,359,358 | 11/1982 | Hattemer . |
| 4,367,312 | 1/1983 | Bontinck et al. . |
| 4,419,396 | 12/1983 | Sugimoto . |
| 4,427,484 | 1/1984 | Cameron, Jr. et al. . |
| 4,445,641 | 5/1984 | Baker et al. . |
| 4,483,759 | 11/1984 | Szycher et al. . |
| 4,487,801 | 12/1984 | Turnbull et al. . |
| 4,567,613 | 2/1986 | Meehan . |
| 4,584,175 | 4/1986 | Martenson . |
| 4,606,956 | 8/1986 | Charbonneau et al. . |
| 4,633,533 | 1/1987 | Meehan . |
| 4,720,321 | 1/1988 | Smith . |
| 4,746,567 | 5/1988 | Zelter . |
| 4,751,934 | 6/1988 | Moir et al. . |
| 4,769,264 | 9/1988 | Dreger . |
| 4,786,534 | 11/1988 | Aiken ..... 206/484.2 X |
| 4,808,231 | 2/1989 | Kondis et al. . |
| 4,849,043 | 7/1989 | Instance . |
| 4,874,129 | 10/1989 | DiSapio et al. . |
| 4,880,690 | 11/1989 | Szycher et al. . |
| 4,884,680 | 12/1989 | Israel et al. . |
| 4,889,755 | 12/1989 | Charbonneau . |
| 4,908,252 | 3/1990 | Carnahan et al. . |
| 4,925,517 | 5/1990 | Charbonneau et al. . |
| 4,940,584 | 7/1990 | Tararuj et al. . |
| 4,941,574 | 7/1990 | Meehan . |
| 4,961,493 | 10/1990 | Kaihatsu . |
| 4,998,621 | 3/1991 | Meehan . |
| 5,071,704 | 12/1991 | Fischel-Ghodsian . |
| 5,093,182 | 3/1992 | Ross . |
| 5,160,570 | 11/1992 | Dickey . |
| 5,161,688 | 11/1992 | Muchin . |
| 5,192,386 | 3/1993 | Moir et al. . |
| 5,253,754 | 10/1993 | Soodak ..... 206/484 X |
| 5,367,007 | 11/1994 | Richards . |
| 5,391,420 | 2/1995 | Bootman et al. . |

FOREIGN PATENT DOCUMENTS

| | | |
|---|---|---|
| 0197184 | 10/1986 | European Pat. Off. . |
| 0328003 | 8/1989 | European Pat. Off. . |
| 0431798 | 12/1991 | European Pat. Off. . |
| 2273719 | 6/1974 | France . |
| 269103 | 6/1989 | Germany . |
| 56-22449 | 5/1981 | Japan . |

*Primary Examiner*—Jacob K. Ackun

*Attorney, Agent, or Firm*—Samuels, Gauthier, Stevens & Reppert

[57] ABSTRACT

A sampler package containing a free flowing product having superimposed first and second flexible plies with confronting thermoplastic inner surfaces and oppositely facing outer surfaces. A thermoplastic wall surrounding an area between the confronting surfaces to physically separate and cooperating in a melt-bonded relationship with the wall to define a hermetically sealed chamber configured and dimensioned to contain the product.

16 Claims, 3 Drawing Sheets

SAMPLER PACKAGE AND METHOD OF MAKING THE SAME

FIELD OF THE INVENTION

This invention relates to the packaging of free flowing products in small amounts for distribution as samples or single use unit packages. As herein employed, the term "free flowing" describes dimensionally unstable products, examples of which include liquids, gels, powders, etc.

BACKGROUND OF THE INVENTION

Various devices have been developed for packaging free flowing cosmetic and fragrance products. In one such device disclosed in U.S. Pat. No. 5,391,420 (Bootman et al.), a free flowing fragrance sample is introduced between flexible heat sealable plies, and the plies are then directly and releasably heat sealed one to the other along continuous seams configured to produce hermetically sealed pouches containing the samples. Experience has proven that drawbacks are associated with this type of packaging and its method of production. For example, the speed at which the packaging lines can be operated is disadvantageously limited by the time required to heat the plies to the elevated temperatures required to effect the heat seals. The application of heat to the plies also can degrade the products being encapsulated therebetween. In the case of liquid or gel samples, the heat seals are also prone to hydraulic rupture if the pouches are subsequently subjected to compressive forces, as often occurs as a result of the pouches being incorporated into magazines and the like which normally are bundled and stacked as part of the normal distribution process. Attempts have been made to avoid premature ruptures of pouches by increasing the area encompassed by the heat seals, the result being a larger pouch with a larger surface area and less profile height to accommodate spreading of the sample. However, the spreading of the contents over increased surface area adversely affects the stability and shelf life of the material contained within the pouch. Moreover, the additional materials required to produce larger pouches contributes unfavorably to production costs.

In other known devices of the type disclosed in U.S. Pat. No. 5,161,688 (Muchin), an outer first ply is adhesively applied to one side of a perforated base ply to produce open cavities. Product samples are deposited in the cavities, which are then closed by a second outer ply adhesively applied to the opposite side of the base ply. The interposition of the base ply between the two outer plies contributes to the dimensional stability of the sample containing cavities, which in turn results in improved resistance to pressure induced ruptures. However, the three layer construction reduces the package flexibility and contributes disadvantageously to material and production costs.

A general objective of the present invention is to provide an improved sampler package which either avoids or at least substantially minimizes the above described drawbacks associated with known prior art packages.

A more specific objective of the present invention is the provision of a flexible barrier sampler package with significantly increased resistance to pressure induced ruptures.

A further objective of the present invention is to reduce the total surface area of the sampler package for a given sample amount.

Still another objective of the present invention is the provision of an improved method of manufacturing flexible barrier packages, at increased speeds and without resulting product degradation caused by exposure to elevated temperatures.

SUMMARY OF THE INVENTION

The sampler package of the present invention includes superimposed first and second flexible plies having inner confronting thermoplastic surfaces and oppositely facing outer surfaces. A narrow continuous thermoplastic wall surrounds an area between the confronting thermoplastic surfaces. The wall separates and cooperates in a melt bonded relationship with the confronting thermoplastic surfaces to define a hermetically sealed chamber appropriately configured and dimensioned to contain a product sample.

Preferably, the continuous wall is introduced between the confronting inner ply surfaces in a molten state, and thereafter solidifies while fusing to both surfaces.

DETAILED DESCRIPTION OF THE ILLUSTRATED EMBODIMENTS

Figure 1:
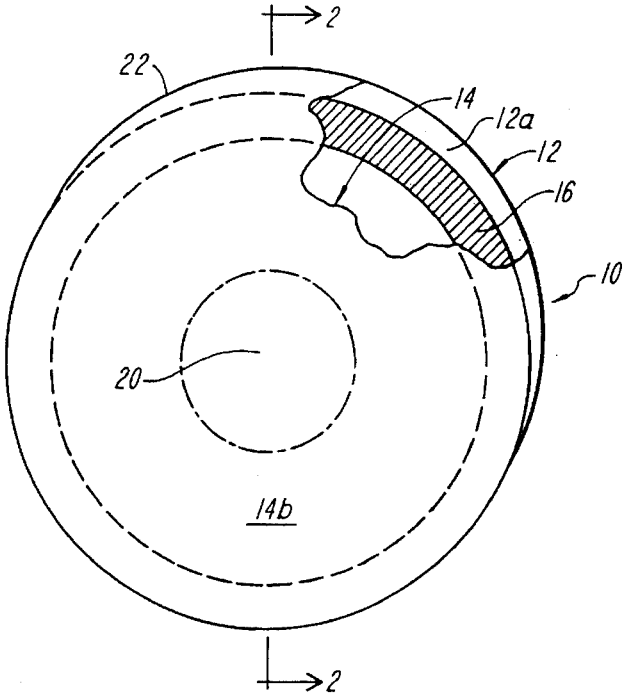
FIG. 1 is a top plan view, partially broken away, of a sampler package in accordance witch the present invention.
Figure 2:
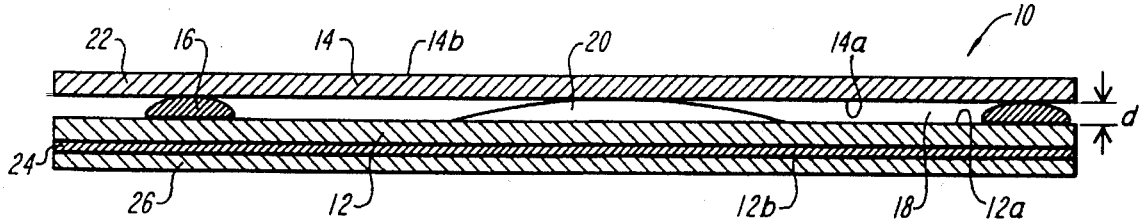
FIG. 2 is a sectional view on an enlarged scale taken along line 2—2 of FIG. 1.

Referring initially to FIGS. 1 and 2, a sampler package in accordance with the present invention is shown at 10. The sampler package comprises superimposed first and second flexible plies 12, 14 respectively having confronting inner thermoplastic surfaces 12*a*, 14*a* and oppositely facing outer surfaces 12*b*, 14*b*. As will hereinafter be described in greater detail, the plies 12, 14 preferably have multilayer composite structures. A narrow bead-shaped thermoplastic wall 16 surrounds an area between the confronting thermoplastic surfaces 12*a*, 14*a*. The confronting surfaces 12*a*, 14*a* are physically separated by and cooperate in a melt-bonded relationship with the wall 16 to define a hermetically sealed chamber 18 appropriately configured and dimensioned to contain a product sample 20, which may typically comprise a liquid or gel-like product. The wall 16 is spaced inwardly from at least a portion of the sampler periphery to provide a peel tab 22.

The outer surface 12*b* of ply 12 may optionally be coated with a pressure sensitive adhesive 24 and a removable release liner 26.

The dimension "d" of physical separation provided between the surfaces 12*a*, 14*a* by the wall 16 will typically range from 0.075 to 1.500 mm, preferably between 0.070 to 0.125 mm.

The peel strength required to separate the ply 12 from the wall 16 is preferably between 265 and 1785 grams per centimeter of wall length, and is greater than the peel strength required to separate the ply 14 from the wall 16. Preferably the peel strength of the ply 14 to the wall 16 ranges from 130 to 625 grams per centimeter of wall length.

Peel strengths are measured by pulling the plies 12, 14 from the wall 16 at 180° at a travel rate of approximately 30.5 centimeters (12 inches) per minute. Peel strengths are measured according to TAPPI T-494 (Technical Association of the Pulp and Paper Industry).

The plies 12, 14 preferably range from 0.025 to 0.508 mm in thickness, and as previously noted, typically comprise multilayer composites having confronting inner polymeric thermoplastic sealant layers selected from the group consisting essentially of polyethylene, (e.g. UCB Rayopeel®) polypropylene, Dupont EMA® (ethylene methacrylate copolymer) or Dupont Surlyn® Ionomer, Dow EAA® (ethylene acrylic acetate) or co-polymers or blends thereof containing polybutylene, EVA (ethylene vinyl acetate) and/or polystyrene.

An outer layer of each ply 12, 14 may include oriented polyester or polypropylene, cellophane, paper, tag stock, cast or blown films of co-polymers of polyester, polypropylene or a copolymer thereof, aluminum foil or polyamide.

Each ply 12, 14 can also include an optional barrier enhancing core layer of aluminum foil, polyvinyl dichloride ("PVDC"), metalized polyester, polypropylene or polyethylene, or mono or biaxially oriented films of polyethylene, polypropylene, polyester, polyamide, acrylonitrile, silicon dioxide coated films, or PVDC coated films. Optional adhesive or thermoplastic "tie" layers may be incorporated between the above described layers of each ply.

The wall 16 may consist of polyethylene, polypropylene, EVA or blends or co-polymers thereof, with the material selection being determined by its compatibility with the inner thermoplastic sealant layers of the top and bottom plies 14, 12.

A preferred method of manufacturing sampler packages according to the present invention will now be described with further reference to FIGS. 3 and 4. The first ply 12 is withdrawn horizontally from a supply roll 30 at zone A and is directed downstream with its inner thermoplastic surface 12*a* facing upwardly. As noted previously, the underside 12*b* of the first ply 12 may include an adhesive and a release liner.

At zone B free flowing product samples 20 are dispensed from nozzles 32 onto the upper surface 12*a* of the ply 12. The nozzles 32 are preferably equipped with electronically controlled high speed valves 33 of the type known to those skilled in the art. The valves 33 serve to precisely meter the flow of product from a reservoir 35.

Figure 3:
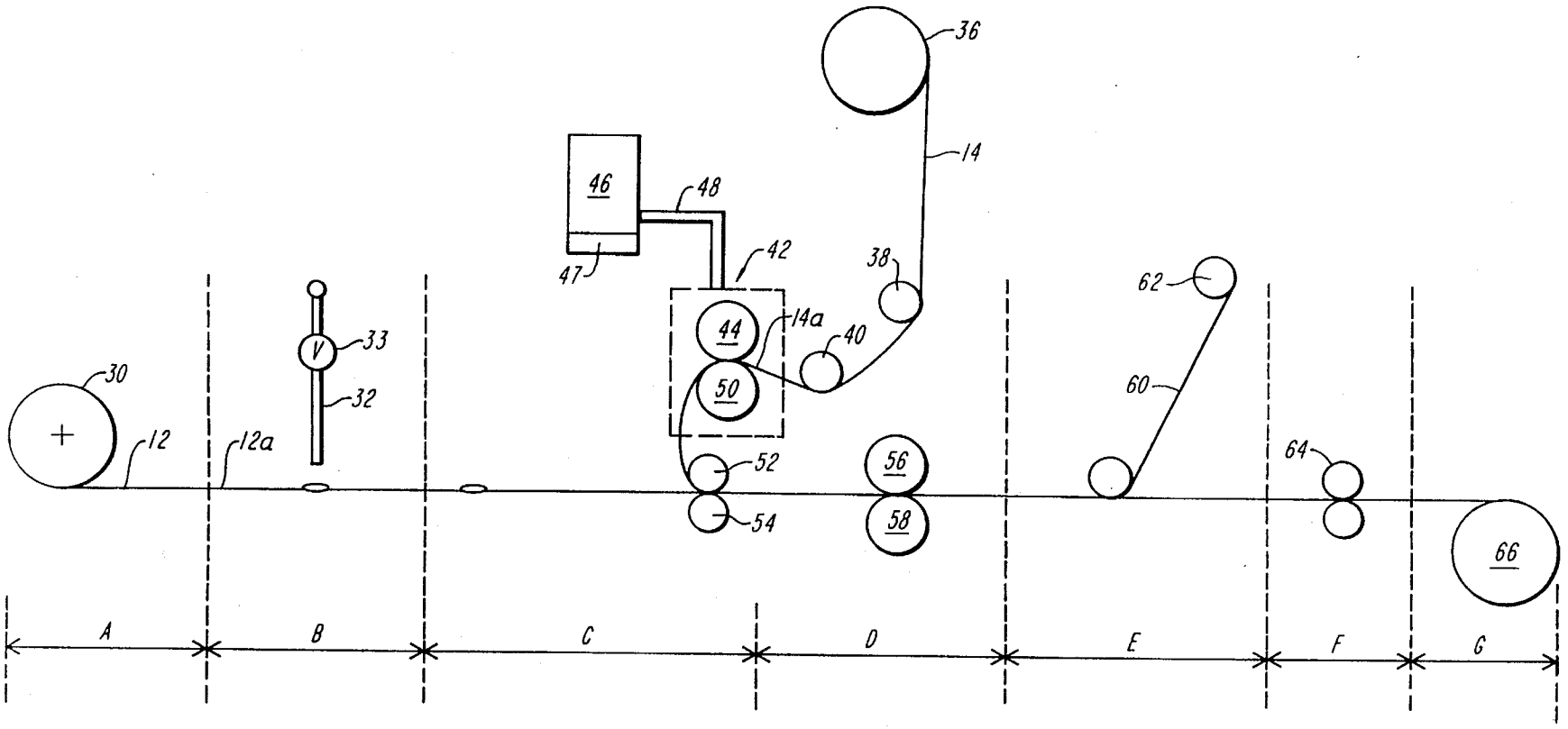
FIG. 3 is a schematic illustration of a typical processing line for producing sampler packages in accordance with the present invention.
Figure 4:
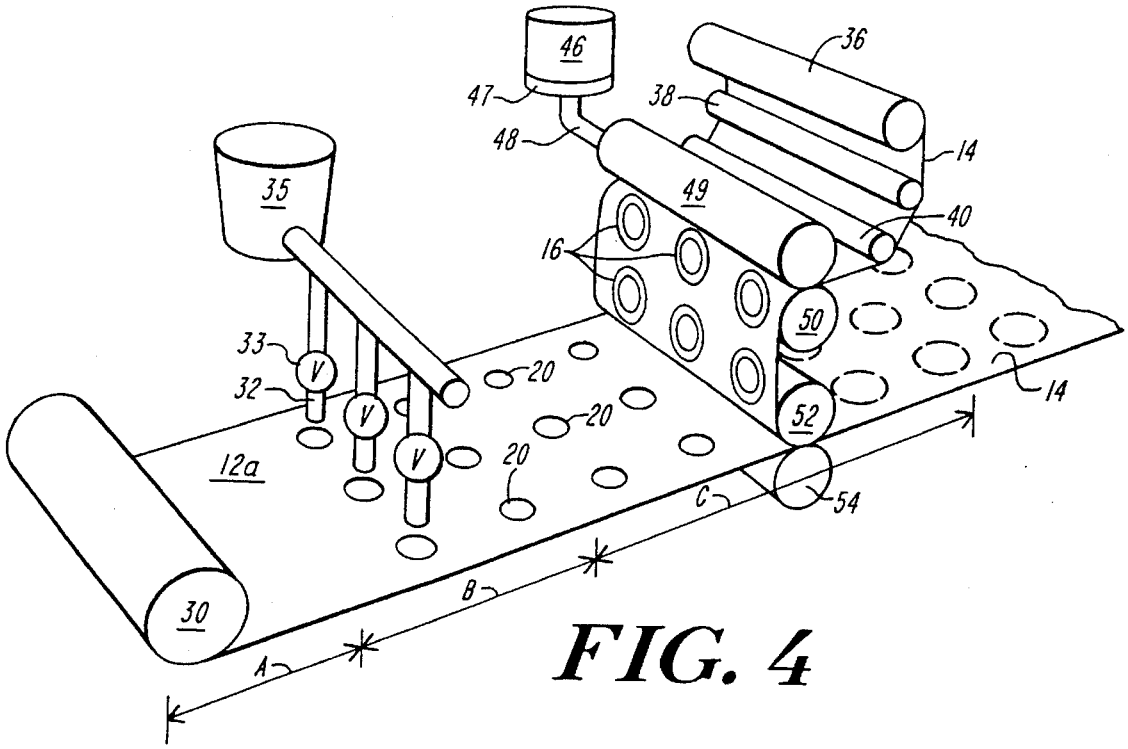
FIG. 4 is a diagrammatic perspective view of a portion of the processing line shown in FIG. 3.

At zone C, the second ply 14 is withdrawn from a second supply roll 36 and is directed downwardly around idler rolls 38 and 40 to a screen printer generally indicated in FIG. 3 at 42. The screen printer can comprise, for example, a Teknaprint Model SP-117 screen printer supplied by ITW Dynatec of Henedersonville, Tenn. The screen printer utilizes a rotating, etched screen 44 to apply precise patterns of molten thermoplastic to the inner surface 14*a* of the ply 14. In the embodiment herein being described, the precise patterns are in the form of generally circular bead-like walls 16.

Although not illustrated in detail in the drawings, it will be understood that the screen printer 42 is fed with the molten thermoplastic from an off-line supply unit 46 via a heated hose 48. The thermoplastic wall material is heated to a molten state "off line", for example by a heater 47 associated with the supply unit 46. The molten thermoplastic is then introduced into the rotating screen cylinder 44 and is dispensed therefrom onto the inner surface 14*a* of the ply 14 in the exact pattern that has been etched into the screen. This occurs at the closest point between the screen cylinder 44 and a companion back-up roll 50.

As the ply 14 leaves the screen cylinder 44, it is directed downwardly into the nip defined by rolls 52, 54. The molten bead-shaped walls 16 arrive in registration with the product samples 20 on the horizontally moving lower ply 12. As the molten walls 16 pass between the rolls 52, 54, they are compressed between the plies of the thermoplastic surfaces 12*a*, 14*a* of the respective plies 12, 14. The thermal energy stored in the walls 16 then transfers to the surfaces 12*a*, 14*a* thereby causing the walls to join and fuse in a melt bonded relationship with the surfaces 12*a*, 14*a*.

The thermoplastic wall material is dispensed from the screen cylinder 44 at a temperature ranging from about 90° to 230° C., preferably between about 175° to 230° C. Immediately upon deposition on the ply surface 14*a*, and prior to entry between the rolls 52, 54, the molten walls have a thickness ranging from about 1.25 to 1.50 mm.

The parting between the rolls 52, 54 is selected to insure intimate contact of the surfaces 12*a*, 14*a* with the walls 16, and to achieve the desired dimension of separation "d" caused by the interposition of the walls 16 between the two plies 12, 14. Typically, dimension "d" is in the range of 0.076 to 1.500 mm.

As the plies 12, 14 exit from between the rolls 52, 54, the thermoplastic layers 12*a*, 14*a* and the thermoplastic walls 16 set in a solid state. The plies 12, 14 fuse to the opposite sides of the walls 16, the latter surrounding the product samples 20. At a downstream zone D, a rotary Cutting die 56 is employed in conjunction with a back-up roll 58 to die cut the resulting laminated structure into individual sampler packages interconnected by a carrier sheet (typically the release liner). The excess material 60 surrounding the individual sampler packages is stripped off and accumulated on a take-up roll 62. In zone F, the web may optionally be slit at 64 into narrower rolls each containing an individual row of sampler packages. In zone G, the sampler packages are then accumulated in finished rolls at 66.

It will be understood that the elapsed time between the application of the molten thermoplastic walls 16 to the ply 14 at the rotating etched screen 44 and the joinder of the plies 12, 14 at the nip defined by rolls 52, 54 is preferably extremely brief, typically ranging from about 0.2 to 6.0 seconds. During this brief interval, the walls 16 remain molten, and as such retain sufficient thermal energy to effect melting of the thermoplastic surfaces 12*a*, 14*a*, with a resulting highly effective melt bonding of those surfaces to the walls.

Processing speeds will depend on the combination of materials being incorporated into the sampler packages. However, considerable advantages derive from the use of molten thermoplastic material to create the bead-like walls 16. Processing speeds are not limited by the off-line heating of the wall material, and fusion of the molten wall material to the thermoplastic inner surfaces 12*a*, 12*b* is effected quickly without having to heat the entire thickness of the plies 12, 14. Of additional advantage in this regard is the minimum exposure of the product samples 20 to elevated temperatures.

Typical line speeds possible with the above-described process are upwards of 90 meters per minute. This rate is approximately three times the processing speeds which can be carried out reliably with typical rotary heat seal equipment.

SAMPLE DESCRIPTION

Sampler packages according to the present invention were prepared utilizing top and bottom plies 14, 12 fused to opposite sides of a thermoplastic wall 16 surrounding a product sample 20. The bottom ply 12 comprised a laminate which from bottom to top included: 1.5 mil silicone release liner; 0.75 mils pressure sensitive acrylic adhesive; 48 gauge polyester film; polyethylene film (7 lbs. per ream); 0.003 inch aluminum foil; and 0.00075 inch polyethylene film. The top four layers were joined one to the other with permanent acrylic adhesive.

The top ply 14 comprised a laminate which from bottom to top included: 2 mil polyethylene coextrusion (UCB Rayopeel®); 0.0003 inch aluminum foil; 48 gauge oriented polyester. These layers were joined one to the other with a permanent acrylic adhesive.

The product sample 20 consisted of approximately 50 mg of a liquid cosmetic lotion with a viscosity of 1000 cps applied to the upper surface 12*a* of bottom ply 12 as a generally circular deposit measuring approximately 12 mm in diameter.

The wall 16 consisted of Eastobond A-32 adhesive polymer, Eastman Chemical Co., Kingsport, Tenn., applied to the surface 14*a* of the ply 14 in a molten state at an elevated temperature of 191° C. The wall defined a continuous circular bead of approximately 38 mm in diameter. The wall 16 was then aligned in registration with the product sample 20 and pressed against the upper surface of the bottom ply 12. The molten wall 16 solidified while fusing to both the surfaces 12*a*, 14*a* thereby encapsulating the product sample 20 in a hermetically sealed chamber.

Figure 5A:
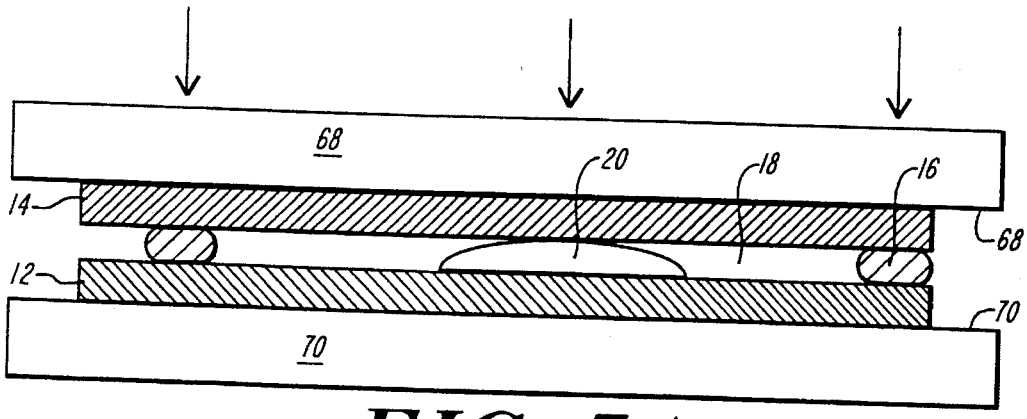
FIGS. 5A and 5B are cross sectional views diagrammatically depicting the application of compressive forces to a sampler package of the present invention.

In light of the foregoing, it will now be appreciated by those skilled in the art that the present invention offers a number of significant advantages as compared to known prior art packages and processing techniques. From the packaging standpoint, and with reference to FIG. 5A, it will be seen that the continuous wall 16 serves to maintain a separation between the plies 12, 14 under conditions where the sampler package is subjected to compressive forces exerted by planar surfaces 68, 70, as would be the case for example if the sampler package were incorporated in a magazine or other like publication. The physical separation provided by the wall 16 insures that the volume of chamber 18 remains substantially intact, thereby avoiding any tendency of the product sample 20 to transmit the compressive forces to the wall 16, and avoiding forces sufficient to produce a hydraulic rupture.

Figure 5B:
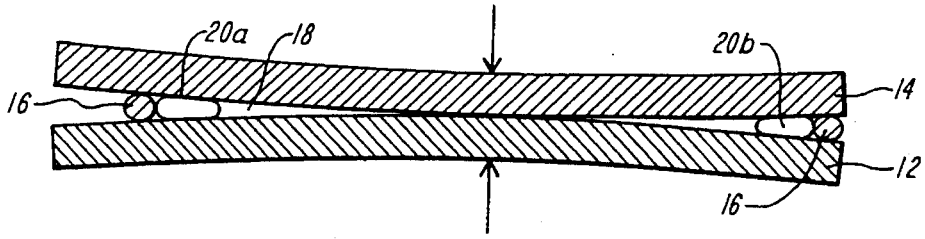

With further reference to FIG. 5B, it will be seen that even under conditions where the sampler package is subjected to central compressive forces causing the two plies 12, 14 to come into contact with each other at the center of the chamber 18, there can still remain adequate chamber volume to accommodate a spreading of the product sample 20 as indicated at 20*a*, 20*b*.

Because the wall 16 maintains a physical separation between the plies 12, 14, the area surrounded by the wall can be reduced while still maintaining an adequate chamber volume for a given quantity of the product sample 20. Smaller sampler packages with a smaller surface area are less expensive to manufacture, in addition to being easier to corporate into the advertising formats of various publications.

The molten wall 16 fuses quickly to the confronting surfaces of the plies 12, 14 with a minimum transfer of heat beyond the areas of contact during fusion. The product samples 20 are thus largely isolated from the detrimental effects of overheating. This rapid fusion also permits line speeds to be beneficially increased.

Various modifications may be made to the sampler packages and method described above without departing from the spirit and scope of the invention. For example, the configuration of the continuous walls 16 can be varied to include, for example, squares, rectangles, triangles, ovals, etc. The molten wall material may alternatively be applied to the upper surface 12*a* of the ply 12 either prior to or after the product samples 20 have been deposited.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

I claim:

1. A sampler package for a free flowing product, said package comprising:

superimposed first and second flexible plies having confronting thermoplastic inner surfaces and oppositely facing outer surfaces; and a thermoplastic wall surrounding an area between said confronting surfaces, said confronting surfaces being physically separated by and cooperating in a melt-bonded relationship with said wall to define a hermetically sealed chamber configured and dimensioned to contain said product.

2. The package of claim 1 further comprising an adhesive applied to the outer surface of one of said plies.

3. The package of claim 1, wherein the dimension of separation between said first and second plies at the juncture of said wall is in the range of 0.00254 to 0.15240 centimeters.

4. The package of claim 3, wherein the dimension of separation between said first and second plies is preferably 0.00762 to 0.07620 centimeters.

5. The package of claim 1, wherein the peel strength of said first ply to said wall is greater than the peel strength of said second ply to said wall.

6. The package of claim 5, wherein the peel strength of said first ply to said wall is between 267.9 and 1786.0 grams per linear centimeter of wall.

7. The package of claim 5, wherein the peel strength of said second ply to said wall is between 133.95 and 625.1 grams per linear centimeter of wall.

8. The package of claim 1, wherein said product is a liquid.

9. The package of claim 1, wherein said product is a powder.

10. The package of claim 1, wherein said first ply has a thickness ranging from 0.00254 to 0.05080 centimeters.

11. The package of claim 1, wherein said second ply has a thickness ranging from 0.00254 to 0.05080 centimeters.

12. The package of claim 1, wherein said first ply comprises a multilayer composite and said inner surface is defined by a thermoplastic sealant layer.

13. The package of claim 1, wherein said second ply comprises a multilayer composite and said inner surface is defined by a thermoplastic sealant layer.

14. The package of either claims 12 or 13, wherein said thermoplastic sealant layer is selected from the group consisting essentially of polyethylene, polypropylene, ethylene methacrylate, ethylene acrylic acetate, polystyrene, ethylene vinyl acetate, polybutylene, ionomers and co-polymers and blends thereof.

15. The package of claim 1, wherein said wall comprises a thermoplastic material.

16. The package of claim 15, wherein said thermoplastic material is selected from the group consisting essentially of polyethylene, polypropylene, ethylene vinyl acetate, ionomers and co-polymers and blends thereof.

* * * * *